US005301119A

United States Patent [19]

Watkins

[11] Patent Number: 5,301,119

[45] Date of Patent: Apr. 5, 1994

[54] DIE DRAFT OPTIMIZING SYSTEM

[75] Inventor: Clinton E. Watkins, Villa Rica, Ga.

[73] Assignee: Southwire Company, Carrollton, Ga.

[21] Appl. No.: 812,382

[22] Filed: Dec. 23, 1991

[51] Int. Cl.[5] ..... G06F 15/46; B21C 1/10; B21C 1/06

[52] U.S. Cl. ..... 364/472; 364/474.02; 72/280

[58] Field of Search ..... 364/474.02, 469, 472; 72/6, 8-12, 278-282, 377, 285, 290

[56] References Cited

U.S. PATENT DOCUMENTS

| | | | |
|---|---|---|---|
| 4,120,186 | 10/1978 | Pamplin et al. | 72/278 |
| 4,291,565 | 9/1981 | Saunders | 72/285 |
| 4,333,148 | 6/1982 | Ivey | 364/472 |
| 4,552,599 | 11/1985 | Masuda et al. | 72/278 |

OTHER PUBLICATIONS

"Wire Drawing Practice: Die Drafting," by Bobby C. Gentry, *Wire Journal*, Aug. 1975.

*Primary Examiner*—Jerry Smith
*Assistant Examiner*—Steven R. Garland
*Attorney, Agent, or Firm*—Stanley L. Tate; James W. Wallis, Jr.; George C. Myers, Jr.

[57] ABSTRACT

An expert system having a computer which can receive input data and from stored data to produce an optimized die draft schedule for a given wire drawing machine. The system is adaptable to store data for a plurality of die drawing machines, producing an optimized die draft schedule for a range of input and output rod/wire sizes on each drawing machine for which the system has stored operating parameters. Alternatively, operating parameters for additional drawing machines can be entered, enabling generation of optimum die draft schedules for most wire drawing machines. An enhanced mode may be made available to enable comparison of computed values and operator estimated values.

22 Claims, 5 Drawing Sheets

ANY DRAWING MACHINE

```
procedure any ;
label 10 ;
begin
  10 :  clrscr ;
  already := false ;
  for i := 1 to 20 do
  begin
     wire[i] := 0 ; length[i] := 0 ;
     slip[i] := 0 ; red[i] := 0 ;
     yourdie[i] := 0 ; yourslip[i] := 0 ;
     yourred[i] := 0 ; speed[i] := 0 ;
     w[i] := 0 ; wirefpm[i] := 0 ;
  end ;
  If anymach then
  begin
    if not samemach then
    begin
      write('ENTER THE MACHINE # OR DISCRIPTION :') ;
      readln(machine) ;
      toomany := true ;
      while toomany do
      begin
        write('Enter the maximum number of dies the machine will take : ') ;
        readln(maxdies) ;
        if maxdies > 20 then
        begin
          writeln(' THIS PROGRAM WILL NOT RUN WITH A MACHINE WITH MORE THAN 20 DIES');
          toomany := true ;
        end
        else toomany := false ;
      end ;
      writeln ;
      write('ENTER THE CAPSTAN SPEEDS') ;
      writeln ;
      write('     Pullout capstan speed : ') ;
      readln(cap[maxdies]) ;
      for i := (maxdies-1) downto 1 do
      begin
        write('     Enter the speed of capstan ',i,' : ') ;
        readln(cap[i]) ;
      end ;
    end ;
  end ;
  rodsize ;          { go get a rod size }
  sizeenter ;
  j := 2 ;
  increase := 0 ;
  print := false ;
  bloop := true ;
```

FIG. 4A

```
while bloop do
begin
  slip[1] := 0.85 · increase ;
  slip[maxdies-1] := 0.95 ;
  factor := (slip[maxdies-1] - slip[1]) /(maxdies-2) ;
  for i := j to (maxdies-2) do
    slip[i] := slip[i-1] + factor ;
  wirefpm[maxdies] := cap[maxdies] ;
  for i := 1 to maxdies-1 do
    wirefpm[i] := cap[i] * slip[i] ;
  wire[maxdies] := size ;
  for i := maxdies downto (j) do
    wire[i-1] := sqrt(sqr(wire[i]) * (wirefpm[i]/wirefpm[i-1])) ;
  rodmin := rod/1.25 ;
  k := j ;
  print := false ;
  loop := true ;
  while loop do
  begin
    if wire[j-1] < rodmin then
    begin
      slip[k] := slip[k-1] ;
      factor := (slip[maxdies-1] - slip[j])/(maxdies-(j)) ;
      for i := (j) to (maxdies-2) do
        slip[i] := slip[i-1] + factor ;
      for i := (j-1) to maxdies-1 do
        wirefpm[i] := cap[i] * slip[i] ;
      for i := maxdies downto (j) do
        wire[i-1] := sqrt(sqr(wire[i]) * (wirefpm[i]/wirefpm[i-1])) ;
      k := k + 1 ;
      if k = maxdies then
      begin
        loop := false ;
        print := true ;
        increase := increase + 0.004 ;
      end ;
    end
    else if wire[j-1] > (rod*0.92) then
      j := j + 1
    else
    begin
      bloop := false ;
      loop := false ;
    end ;
  end ;
end ;
for i := (j-1) to maxdies do
  slip[i] := ( 1 - (wirefpm[i]/cap[i])) * 100 ;  {% slip between capstans}
red[j-1] := ( 1 - (sqr(wire[j-1])/sqr(rod))) * 100 ;
for i := (j) to maxdies do
  red[i] := ( 1 - (sqr(wire[i])/sqr(wire[i-1]))) * 100 ;  {% reduction between capstans}
```

FIG. 4B

DIE DRAFT OPTIMIZING SYSTEM

TECHNICAL FIELD

The present invention relates to a method and an apparatus for optimizing the die drafts in a series of die drafting operations in performing a wire die draft reduction of elongated rod or wire stock. More particularly, the invention is directed to a computer-based expert system for selecting a preferred die draft schedule, including permissible slip values, for a rod or wire die drafting manufacturing operation.

BACKGROUND OF THE INVENTION

Selection of appropriately sized dies in a die drafting operation has heretofore involved choosing ever smaller die apertures based on the experience or set of experiences of an operator, which are often reduced to a chart or series of approximation calculations.

Most die draft selection techniques rely on standard area reductions between each die to calculate the die draft. This method works well when the selected sizes are based on standard reductions, such as Brown and Sharp size reductions. It may not work well for odd sizes or unusual rod materials. Problems can also arise when drawing non-standard materials or special alloys.

One known method of selecting the various dies is described in "Wire Drawing Practice: Die Drafting," by Bobby C. Gentry, published in *Wire Journal*, August 1975. This calculation-based approximation technique is based on many years of practice and experience. Since each successive die size calculation relies on previous die size calculations, each calculation must be carefully verified to eliminate errors in the die draft schedule.

A chart or table is prepared from calculations incorporating a fixed ten percent slip rate between the capstan surface velocity ("capstan velocity") and the wire linear velocity ("wire velocity"). An optimal die draft schedule may require repeated adjustment of calculated values. A tenth-gauge reduction table is usually generated, from which the dies are selected. This time-consuming effort is imprecise and expensive, as it may, if erroneous, result in wire breaks which require restringing the rod, and is inherently consumptive of the engineer's valuable time.

As can be readily appreciated, the analysis of hundreds of wire drafting parameters in producing an efficient and effective wire drafting schedule for various rod and wire sizes on a given wire-drafting machine can be an extraordinarily time-consuming task because of the numerous combinations and permutations of the relevant parameters, and may require repeated adjustments, even if slight in magnitude, in order to provide effective and efficient operation of the wire drawing machine or machines.

In view of the foregoing limitations and shortcomings of the prior art methods and apparatus, as well as other disadvantages not specifically mentioned above, it should be apparent that there exists a need in the art to eliminate imprecision and time-consuming trial-and-error methods of die selection. It is, therefore, a primary object of this invention to fulfill that need by providing a computer-based system of selecting dies for a given rod/wire size requirement.

An advantage of the present invention resides in the fact that the intellectual expertise of the skilled engineer and operator are combined in a computer-based application wherein little skill in generating the die draft schedule is required for reliable and economic operation.

SUMMARY OF THE INVENTION

Briefly described, the aforementioned objects are accomplished according to the invention by providing a computer-based expert system with a plurality of databases including available die sizes, drawing machine parameters including capstan velocity (i.e., capstan surface velocity) and number of blocks, standard rod sizes and desired wire sizes.

The method of selecting the dies intervening between the rod input and wire output involves the steps of determining the rod input and wire output sizes; inputting the beginning and ending slip percentages which may involve estimations of these data values; determining the slip increment and dividing by the number of dies less one, where the slip increment is determined by deducting from the beginning slip value the ending slip value and dividing by the number of dies less one; multiplying the capstan velocity by the slip (expressed as a decimal value) to determine the wire velocity; calculating each wire size by the wire velocity; comparing the calculated wire size and the desired wire size; recalculating the calculated and desired wire sizes and outputting the resultant values to the slip increment determining step until the calculated and desired sizes are equal; and listing the wire size, percentage slip, and area reduction according to each of the blocks in the die draft schedule.

The expert system apparatus includes a computer including a memory unit, a control unit, an arithmetic logic unit, and an input/output unit; a program instruction set; a data storage unit including stored data in a plurality of databases; a keyboard or the like for entering data relating to input material size and output wire size, starting and ending slip and a slip increment; at least one controlled communications pathway for exchanging data between said computer and said data storage unit; and a device for outputting said optimized die draft schedule in human cognizable form; the program instruction set being adapted for iterative calculation of a plurality of slip increments according to the formula:

$$\text{slip increment} = (\text{slip start} - \text{slip finish})/\text{number of dies} - \text{one}$$

and iterative calculation of a plurality of die sizes from the formula:

$$\text{wire velocity} = \text{capstan velocity} \times \text{slip}.$$

DESCRIPTION OF THE DRAWINGS

With the foregoing and other objects, advantages, and features of the invention which will become hereinafter apparent, the nature of the invention may be more clearly understood by reference to the following detailed description of the invention, the appended claims, and to the several views illustrated in the attached drawings.

FIGS. 4A and 4B set forth a subroutine for adapting the program instruction set for use with most conventional wire drafting machines.

DETAILED DESCRIPTION OF THE PREFERRED EMBODIMENT

Figure 1:
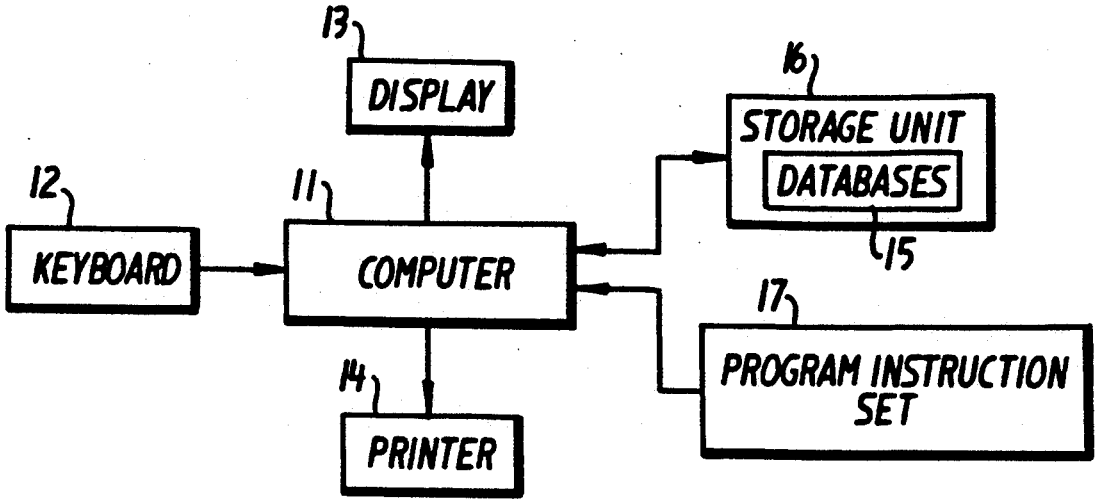
FIG. 1 is a simplified block diagram of the expert die draft system.

Referring now to FIG. 1, a preferred embodiment of the die draft expert system for optimizing wire drawing die schedules is shown, including a computer 11 adapted to receive input from a keyboard 12, a display unit 13, and/or a printer 14 for output of data in human cognizable form. The computer 11, communicates with one or more databases 15 in a storage unit 16 for exchange of data.

Figure 2:
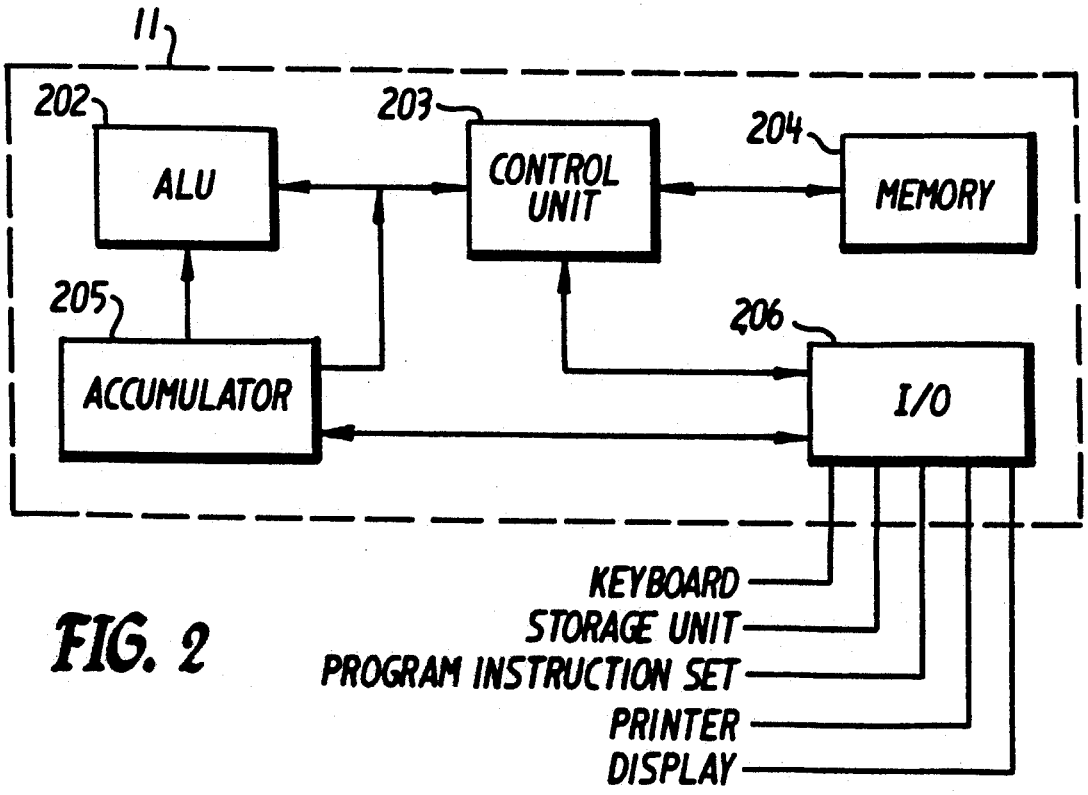
FIG. 2 is a simplified diagram of the computer shown in FIG. 1.

Shown in FIG. 2, the computer 11 is of conventional design; it can be a microprocessor, which includes an Arithmetic Logic Unit ("ALU") 202, a control unit 203 communicating with the ALU 202 and with an I/O function 206. A memory unit 204 communicates with control unit 203 for temporary storage. An accumulator 205 communicating with the ALU 202, control unit 203, and I/O unit 206 is often included for additional temporary storage of data. Computer 11 interactively operates under control of a program instruction set 17, all or part of which may be retained in storage unit 16 or in the computer internal memory unit 204 during operation. These elements may be configured as a personal computer for convenience. One of ordinary skill in the computer programming arts can without unnecessary experimentation prepare the program instruction set from FIGS. 1–4 and the following description.

An illustration of the computer, including such a microprocessor 201, is shown in FIG. 2. ALU 202 performs logical operations such as AND, OR, etc., and arithmetic operations such as addition, subtraction, multiplication, and division. The control unit 203 directs operation of the computer from the memory 204 instructions and executes these instructions. The accumulator 205 is usually included to temporarily store data. The I/O unit 206 handles the input and output operations, sending and receiving signals to and from the microprocessor 201.

Figure 3:
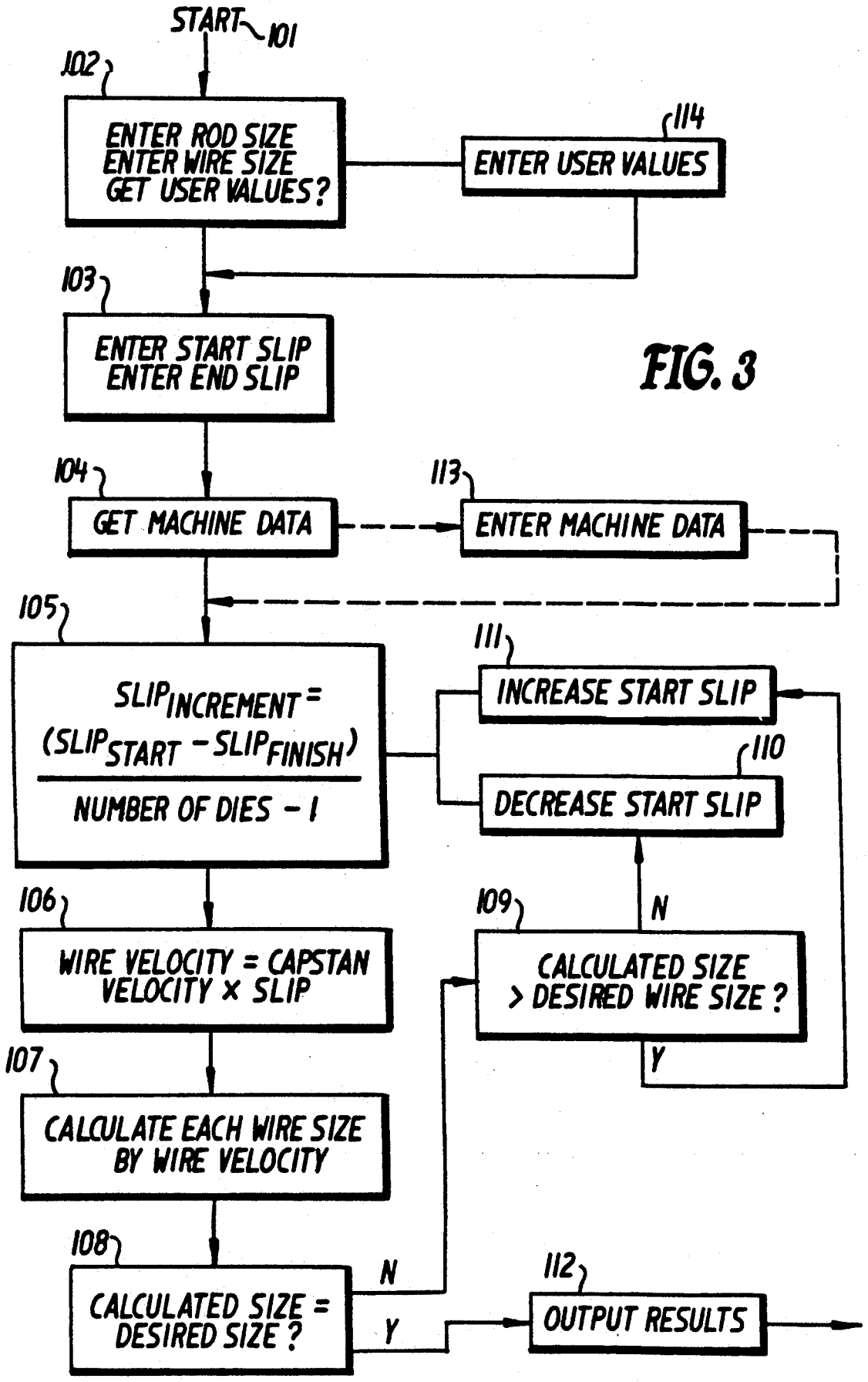
FIG. 3 is a simplified flow diagram of the expert die draft schedule system.

The method of the invention is shown more clearly in FIG. 3, an illustrative block diagram of the invention in flow terms, in connection with the apparatus illustrated in FIGS. 1 and 2. Upon initialization at START 101, the display 13 prompts the user at block 102 for input into computer 11 of the rod size, then the output wire size. The input of this and subsequent user supplied data values is accomplished conventionally via keyboard 12. The input order of these two data elements may be reversed; the data is preferably stored in the computer memory unit 204, but may also be written to storage 16 for recall.

As the wire passes over capstans in the drawing machine, the wire is pulled along a predetermined path at a given linear velocity. The wire velocity and the capstan velocity are not equal; the wire travels slower than the capstan surface at all but the final capstan. This difference is called "slip" herein. Starting and ending slip data values for the respective capstans before and after the dies are next selected at block 103; these values may be input by the user at block 114 or predetermined by the program instruction set 17. A typical starting slip data value is fifteen per cent, but this value may vary according to many determinants, including the drawing machine, the wire material being drawn, etc. as known to those of ordinary skill in the art. Alternate values range between about ten percent and about 20 percent. The ending slip data value may also be input by the user or predetermined by the program instruction set 17. A typical ending slip data value is about five percent at the next to final die, with alternate values ranging from about two percent to about ten percent. The total slip is evenly distributed among the capstans save for the last die, for which zero slip is desirable. Again, the program instruction set 17 may be configured such that the starting and ending slip data values may be selected in the reverse order.

The machine specific data must be determined; in a simple configuration of the invention, the program instruction set 17 or storage unit 16 contains this data. In a variant embodiment, it may also be determined by the user where the data is unknown or is not preferred by the operator or engineer. This data includes, for example, the number of dies, the capstan surface velocity or capstan angular velocity and diameter at each capstan, and such other specific drawing machine factors as may be desirable. The drawing machine data is obtained in block 104 if known, or entered by the user at block 113 where not known or not stored. Next, the slip increment and the number of dies required are determined by iterative calculation in block 105, according to Equation 1:

$$\text{SLIPincrement} = \frac{(\text{SLIPstart} - \text{SLIPfinish})}{\text{NO. DIES} - 1} \qquad \text{Equation 1}$$

The wire velocity preceding each die is then determined in block 106 according to Equation 2:

$$\text{VELOCITYwire} = \text{VELOCITYcapstan} \times 1 - \text{SLIP} \qquad \text{Equation 2}$$

where slip is expressed as a decimal value.

Once the wire velocity is calculated in block 106, the wire size following each die is calculated in block 107 according to Equation 3:

$$\text{SIZEwire} = \sqrt{(\text{DIEsize})^2(\text{VELOCITYwire}_n/\text{VELOCITYwire}_{n-1})} \qquad \text{Equation 3}$$

where n represents a given capstan and n − 1 represents the preceding capstan.

In block 108, a comparison is made in which the wire size following the final die is compared with the desired wire size; following an affirmative result, i.e., in which the calculated size equals the desired size, the calculated die size values are output in block 112 either to display 13 or printer 14. It is preferred that the die size, percentage slip, and area reduction for each die are listed in columns. Alternatively, the results may also be communicated to the drawing machine area visually or electrically (not shown).

A negative result of the comparison in block 108 leads to a further iteration in the calculation and comparison procedure; blocks 105–108 form a portion of an iterative feedback loop cycle which further includes comparison block 109 plus either slip value decremental block 110 or slip value incremental block 111; the decremental or incremental outputs of blocks 110 or 111 are supplied to block 105 and provide adjustment of the number of dies and the slip data values on successive iterations until the slip increments and number of dies provide the desired degree of reduction and favorable comparison between the calculated wire size and the desired wire size.

In a first illustration of the invention, input of the following rod and wire data values result in the die drafting schedule of Table 1 for a Vaughn wire drawing machine with 10 die blocks.

TABLE 1

| Rod size = 375 mils<br>Desired wire cross section = 100 mils | | | |
|---|---|---|---|
| Block | Size (in) | % Slip | % Area Reduction |
| 1 | 375 | 15.0 | 0.0 |
| 2 | 339.7 | 13.8 | 18.0 |
| 3 | 285.7 | 12.5 | 29.2 |
| 4 | 241.0 | 11.3 | 28.9 |
| 5 | 205.2 | 10.0 | 27.5 |
| 6 | 173.5 | 8.8 | 28.5 |
| 7 | 147.0 | 7.5 | 28.2 |
| 8 | 126.5 | 6.3 | 26.0 |
| 9 | 109.5 | 5.0 | 25.0 |
| 10 | 100.0 | 0.0 | 16.6 |

In another illustration of the invention, input of the following data values result in the die drafting schedule of Table 2 for a Vaughn wire drawing machine with 13 die blocks.

TABLE 2

| Rod size = 375 mils<br>Desired wire size = 64 mils | | | |
|---|---|---|---|
| Block | Size (in) | % Slip | % Area Reduction |
| 1 | 375 | 15.0 | 0.0 |
| 2 | 301.4 | 14.1 | 35.4 |
| 3 | 261.3 | 13.2 | 24.8 |
| 4 | 226.4 | 12.3 | 25.0 |
| 5 | 196.1 | 11.4 | 25.0 |
| 6 | 169.6 | 10.5 | 25.2 |
| 7 | 146.5 | 9.5 | 25.3 |
| 8 | 126.9 | 8.6 | 25.0 |
| 9 | 110.1 | 7.7 | 24.7 |
| 10 | 95.4 | 6.8 | 24.8 |
| 11 | 82.7 | 5.9 | 24.8 |
| 12 | 71.9 | 5.0 | 24.5 |
| 13 | 64.0 | 0.0 | 20.7 |

In an enhanced embodiment, certain of the data values may be entered by the user and compared with the optimized values produced by the die draft optimizing system. The comparison of the user-selected die sizes and the computer optimized die schedule provides a convenient reference guide for unusual situations. This enhanced embodiment is especially useful when preparing to draw specially treated rod, unusual rod sizes, or merely different alloys or materials than normal. In this enhanced embodiment, the user is interrogated whether a user-supplied die draft schedule is to be entered; preferably after entry of the rod and wire sizes at block 102. Alternatively, this question may be asked at any of blocks 102–104. (Slip data values are entered at block 103.)

Then the operator is to enter data values for the particular drawing machine at block 114, such as the number of dies and each respective die size for comparison with the computed die draft schedule. Upon completion of the computed die draft schedule, the values are displayed side-by-side on display 13 (and/or output on printer 14) for direct comparison and modification. A subroutine is added to the program instruction set 17 to accomplish this purpose. An example for this subroutine is illustrated in FIGS. 4A and 4B. This subroutine example is limited to 20 dies.

Figure 5:
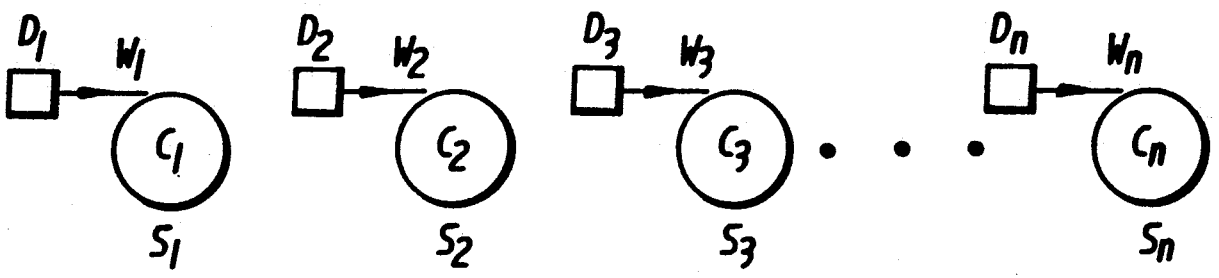
FIG. 5 illustrates die drafting in simplified form.

A simplified illustration of the die drafting process is set forth in FIG. 5. A rod or wire of given size enters a die block and is pulled along by a rotatable capstan in a sequence of wire cross section reducing steps. In FIG. 5, $C_x$ represents each of a plurality of rotatably driven capstans, each capstan having a progressively faster surface velocity (left to right in FIG. 5) $C_1 \ldots C_n$; $D_x$ represents each of a 35, plurality of drawing dies, each having a progressively smaller die section $D_1 \ldots D_n$; and $W_x$ represents the wires exiting each of the dies, where $W_1 \ldots W_n$ are the respective linear velocities of the wire after exiting a given die. Each of the wire sections save the last wire section ($W_n$) travels at a linear velocity less than the surface velocity of the respective driven capstan, the difference $S_x$ here being referred to as slip, expressed as a percentage or as the difference of 1 less the decimal expression of the percentage; a specific slip value is associated with each of the capstans: $S_1 \ldots S_n$.

Given capstan surface velocities (or determining the surface velocity from the capstan angular velocity and the capstan diameter) either from a user input or from a database, and given the last die diameter, i.e., the desired wire size, and given the slip (being equally divided among the capstans save the last capstan: $C_n = W_n$), $$W_{n-1} = C_{n-1} \times S_{n-1} \qquad \text{Equation 4}$$

where S is given as 1 less the percentage slip expressed as a decimal value, the wire linear velocity is equal to the capstan surface velocity time the slip.

Each of the next preceding die sizes can be calculated for each die because the same quantity of rod/wire volume relative to the wire velocity must be distributed along each capstan over a given time, therefore:

$$D_{n-1} = \sqrt{(D_{n-1})^2 \, W_n / W_{n-1}} \qquad \text{Equation 5}$$

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. An optimized die draft schedule expert system for a re drawing machine having a plurality of capstans and dies arranged in sequence and in which a wire may be drawn through the dies, comprising a data storage unit including stored data in a plurality of databases; a computer; a program instruction set; means for entering data relating to input material size and output material size, and starting and finishing slip; and means for outputting said optimized die draft schedule; wherein said program instruction set is adapted for iterative calculation of a plurality of slip increments according to the formula:

$$\text{slip increment} = \frac{(\text{slip start} - \text{slip finish})}{\text{number of dies minus 1}}$$

and for iterative calculation of a plurality die sizes based on the formula:

wire linear velocity = capstan surface velocity × slip.

2. The expert system of claim 1, wherein said program instruction set is adapted for calculation of die size according to the formula:

$$SIZEwire = \sqrt{(DIEsize)^2(VELOCITYwire_n/VELOCITYwire_{n-1})}$$

where n represents a given capstan and n − 1 represents the preceding caps a in said sequence and SIZEwire is the size of the wire following the die.

3. The expert system of claim 1, wherein said program instruction set is adapted to determine whether to increment or decrement the number of dies in the slip increment calculation.

4. The expert system of claim 3, wherein said program instruction set is adapted to increment the number of dies in the slip increment calculation by one.

5. The expert system of claim 3, wherein said program instruction set is adapted to decrement the number of dies in the slip increment calculation by one.

6. The expert system of claim 1, wherein said program instruction set is adapted to interrogate whether a user-supplied die draft schedule is to be entered.

7. The expert system of claim 1, wherein said computer includes a memory unit, a control unit, an arithmetic logic unit, and an input/output unit.

8. The expert system of claim 1, further including means for exchanging data between said computer and said data storage unit.

9. The expert system of claim 1, wherein said program instruction set is resident in said data storage unit.

10. The method of determining an optimized die draft schedule in an expert system for a wire drawing machine including a plurality of capstans and dies in sequence, said expert system including means for entering, a computer, a program instruction set, and a storage unit, comprising the steps of:

a) entering an input rod size;
b) entering an output wire size;
c) determining a starting slip data value;
d) determining an ending slip data value;
e) determining a set of drawing machine operating parameters;
f) calculating a slip increment value;
g) calculating each of a plurality of preceding wire velocity values;
h) calculating each of a plurality of preceding wire sizes by said wire velocity values; and
i) comparing a calculated wire size and a desired wire size.

11. The method according to claim 10, wherein said slip increment value calculation is accomplished by iterative calculation according to the formula:

$$\text{slip increment} = \frac{(\text{slip start} - \text{slip finish})}{\text{number of dies} - 1}.$$

12. The method according to claim 10, wherein said wire velocity values are calculated by iterative calculation according to the formula:

wire velocity = capstan velocity × slip.

13. The method according to claim 10, wherein each preceding wire size is calculated in step h) according to the formula:

$$SIZEwire = \sqrt{(DIEsize)^2(VELOCITYwire_n/VELOCITYwire_{n-1})}$$

where n represents a given capstan and n − 1 represents the preceding capstan in said sequence and DIEsize is the size of the die.

14. The method according to claim 10, wherein said wire velocity values are calculated by iterative calculation based on the formula:

wire linear velocity = capstan surface velocity × slip and each preceding wire size is calculated in step h) according to the formula:

$$SIZEwire = \sqrt{(DIEsize)^2(VELOCITYwire_n/VELOCITYwire_{n-1})}$$

where n represents a given capstan and n − 1 represents the preceding capstan in said sequence and DIEsize is the size of the die.

15. The method according to claim 10, wherein the step of determining a set of drawing machine operating parameters is accomplished by reference under program instruction set control to a database resident in said storage unit.

16. The method according to claim 10, wherein the step of determining a set of drawing machine operating parameters is answered by user entered data.

17. The method according to claim 10, wherein the step of determining a starting slip data value is accomplished by reference under program instruction set control to a database resident in said storage unit.

18. The method according to claim 10, wherein the step of determining a starting slip data value is answered by user entered data.

19. The method according to claim 10, wherein the step of determining an ending slip data value is accomplished by reference under program instruction set control to a database resident in said storage unit.

20. The method according to claim 10, wherein the step of determining an ending slip data value is answered by user entered data.

21. The method according to claim 10, wherein steps a) and b) are grouped as a single function.

22. The method according to claim 10, wherein steps c) and d) are grouped as a single function.

* * * * *